United States Patent [19]

Brokmann et al.

[11] 4,112,163

[45] Sep. 5, 1978

[54] NET FOR FORMING AN ELASTIC SUPPORT IN FURNITURE

[76] Inventors: Manfred Brokmann, Silcherstr. 5; Kurt Sanders, Friedrichstr. 29; Dieter Sanders, Haneschweg 2; Hermann Westhoff, Augustenburgerstr. 85a, all of, 4500 Osnabrueck, Fed. Rep. of Germany

[21] Appl. No.: 704,769

[22] Filed: Jul. 13, 1976

[30] Foreign Application Priority Data

Jul. 22, 1975 [DE] Fed. Rep. of Germany ..... 2532613

[51] Int. Cl.[2] ..... B32B 5/12

[52] U.S. Cl. ..... 428/107; 156/161; 428/198; 428/224

[58] Field of Search ..... 428/224, 107, 255, 259, 428/198; 156/161, 166, 180, 181

[56] References Cited

U.S. PATENT DOCUMENTS

| | | | |
|---|---|---|---|
| 3,351,205 | 11/1967 | Butler et al. | 156/161 |
| 3,395,744 | 8/1968 | Wolf et al. | 428/259 |
| 3,501,366 | 3/1970 | Bromley et al. | 428/107 |
| 3,573,130 | 3/1971 | Vinton et al. | 156/166 |
| 3,733,243 | 5/1973 | Crawford | 428/107 |
| 3,813,098 | 5/1974 | Fischer et al. | 156/161 |
| 3,950,584 | 4/1976 | Bromley | 428/113 |
| 3,983,280 | 9/1976 | Bromley et al. | 428/107 |

*Primary Examiner*—James J. Bell

[57] ABSTRACT

A net for supporting upholstery in furniture. The net include a plurality of longitudinal and transverse cords arranged perpendicularly relative to each other and forming a plurality of cross-over points. A molded synthetic connecting member is bonded to the transverse and longitudinal cords at their cross-over points and completely encloses both cords in the region of their cross-over points.

3 Claims, 3 Drawing Figures

NET FOR FORMING AN ELASTIC SUPPORT IN FURNITURE

BACKGROUND OF THE INVENTION

The invention relates to a net, in particular a stretched or elastic net for camping furniture, such as chairs or beds. The net of the invention includes longitudinal and transverse cords which are perpendicularly arranged relative to each other. These longitudinal and transverse cords are made out of synthetic filaments or fibers and include connecting members at their cross-over points.

The supporting nets of this type when used in furniture are provided at their cross-over points generally with steel clamps or staples. These steel clamps or staples are generally mounted on the cross-over points of a longitudinal and transverse cord by means of a clamp or stapling gun. Such a steel clamp or staple connection has many drawbacks. For example, such a connection is difficult to be precisely installed because of the way the clamp or stapling gun is handled. An imprecise connection, however, reduced the elasticity of the net. Furthermore, it is quite time consuming to install the clamps or staples for such a net. In addition thereto it is necesary to check each connection after it has been installed which is quite time consuming. The production of such nets by means of a clamp or stapling gun is therefore quite costly.

In addition thereto, it is well known that such nets, in particular when they are used as an elastic support for camping furniture, have only a short useful life because the steel clamps are very rapidly destroyed by corrosion. Furthermore, the upholstering or similar seating surfaces are frequently damaged by the steel clamp or staples of the supporting net. Also the frequent use of the net may cause an abrasion of the cords by the steel clamps or staples at the cross-over points.

SUMMARY OF THE INVENTION

It is a principal object of this invention to provide a net of the aforedescribed type wherein all the aforedescribed drawbacks have been eliminated or ameliorated. The supporting net of this invention utilizes at the cross-over points of the longitudinal and transverse cords a connecting member made out of molded plastic material which cover and/or encloses completely the cross-over point.

The connecting member of this invention is a molded synthetic body which can be rapidly formed by means of two half molds and is affixed and/or bonded to the cords at the cross-over points of the longitudinal and transverse cords with a high degree of reliability and in a simple manner. The costs for producing and affixing the connecting members is reduced and the time spent for checking the cross-over points after the connecting members have been affixed thereto is shortened. Due to the fact that the molded connecting member is made out of a liquid synthetic and thermoplastic material which is bonded during its formation to the crossing cords causes the resultant connection to be much more intimate after the synthetic material has cooled and therefore the connection is stronger and can be subjected to heavier loads without the danger of a malfunctioning occuring due to corrosion or a damaging of the upholstery or the cords.

The invention also contemplates a prestretching of the longitudinal and transverse cords prior to the application of the connecting member to the cross-over points. Such a prestretching reduces the cross sectional area of the cords. The cords are stretched preferably 2 to 5% lengthwise. After the connecting member has been applied, the prestretching tension of the cords is removed and a strong mutual pressure results between the cords and the cooled connecting body, which in turn results in an increase in cross sectional area of the cords as they return to their originally unstretched length and a contraction of the connecting member. Due to this prestretching the resistance against slideable displacements of the crossing cords is considerably increased (for example twofold) as compared to a connecting member that is merely molded on to unstretched crossing cords.

BRIEF DESCRIPTION OF THE DRAWING

The novel features which are considered as characteristic for the invention are set forth in particular in the appended claims. The invention itself, however, both as to its construction and its method of operation together with additional objects and advantages thereof, will be best understood from the following description of a specific embodiment when read in connection with the accompanying drawing.

DESCRIPTION OF THE PREFERRED EMBODIMENT

Figure 1:
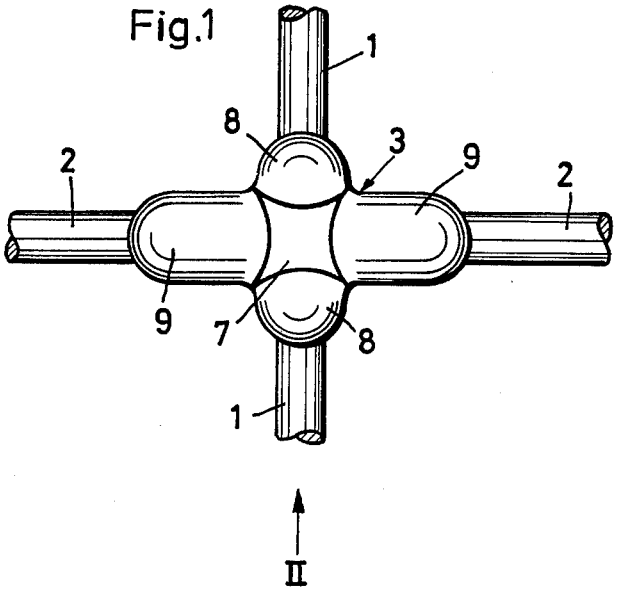
FIG. 1 is a plan view of a cross-over point of a longitudinal and transverse cord of a supporting net in accordance with this invention.
Figure 2:
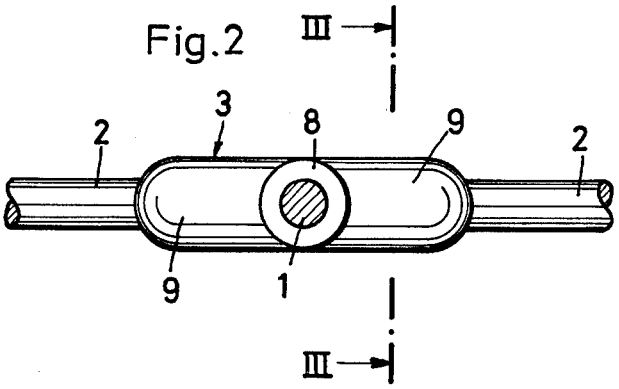
FIG. 2 is an elevational view in the direction of arrow II in FIG. 1.
Figure 3:
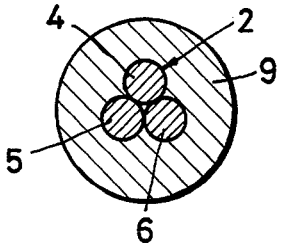
FIG. 3 is a cross-sectional view along line III-III of FIG. 2 in a larger scale than FIGS. 1 and 2.

In the drawing the longitudinal cord is designated with the reference number 1 and the transverse cord is designated with the reference number 2. Only portions of these cords are depicted in order to illustrated a typical cross-over point. At such a typical cross-over point of cords 1 and 2 there is provided a connecting member 3 which has a molded body made out of synthetic material. Thus, the cords 1 and 2 together with the molded body 3 are made out of thermoplastic material. Illustratively, the molded body 3 and the longitudinal cord 1 can be made out of polyethylene, whereas the transverse cord 2 is made out of polyamide. It is conventional to use different synthetic materials having differing elasticity, respectively, differing mechanical properties, for supporting nets in particular for supporting nets in furniture. The transverse cords 2 are formed by three braided strands 4, 5, 6 (see FIG. 3). Each strand is formed by a plurality of fine filaments. The longitudinal cord 1 is similarly formed by means of three braided strands. Each strand can, for example, be composed of about 16 filaments, each of which has a diameter of about 0.3 mm.

The molded synthetic body 3 has a middle region 7 from which two short shanks 8 extend for receiving the longitudinal cord 1. Two longer shanks 9 extend perpendicularly relative to the shanks 8 and are adapted to receive the transverse cord 2. The shanks 8 and 9 have a round rod-like shape. These shanks are rounded at their free ends and firmly grip the strands of each cord. The middle region 7 of the molded body of the connecting member 3 firmly grips the cords 1 and 2 at their cross-over point.

The molded body of the connecting member 3 has longer shanks 9 in order to take into account the fact that the transverse cord 2, which is made out of polyamide, has less adhesion with the body of the connecting member 3, which is made out of polyethylene then the longitudinal cord 1, which is also made out of polyethylene.

Thus, the body of the connecting member 3 can be more easily bonded in the region of its contacting surfaces with the longitudinal cord 1, which also is made out of polyethylene. The plastic material of the body of the connecting member 3 assumes, in the region in which it contacts the longitudinal and transverse cords 1 and 2, the shapes of the respective cords. Thus, the plastic material enters into the grooves and assumes the shapes of the ridges formed by the braided strands 4, 5, 6, of the illustrated example of a three strand cord 1, 2. This intimate bond between the molded body of the connecting member 3 with the cords 1 and 2, as is clearly illustrated in FIG. 3, makes for a very strong connection at the cross-over points of the supporting net for furniture.

Although the invention is illustrated and described with reference to a plurality of preferred embodiments thereof, it is to be expressly understood that it is in no way limited to the disclosure of such a plurality of preferred embodiments, but is capable of numerous modifications within the scope of the appended claims.

What is claimed is:

1. A net for supporting upholstery in furniture, comprising, in combination:

(a) a plurality of longitudinal cords and a plurality of transverse cords extending prependicularly relative to said plurality of longitudinal cords, preselected longitudinal cords contacting preselected transverse cords so as to form a plurality of cross-over points therewith, (b) a molded synthetic connecting member at each cross-over point completely enclosing said longitudinal and transverse cord at said cross-over points, (c) said connecting member having a first pair of shank portions extending in opposite directions along said transverse cord and completely enclosing said transverse cord in the region of the cross-over point, (d) a second pair of shank portions extending in opposite directions along said longitudinal cord and completely enclosing said longitudinal cord in the region of said cross-over point, (e) said shanks of said first pair being longer than said shanks of said second pair, (f) said longitudinal and transverse cords being prestressed prior to molding the connecting members onto the transverse and longitudinal cords at the cross-over points, (g) said transverse and longitudinal cords having uneven surfaces, said enclosing connecting member contacting completely said uneven surfaces in the region of said cross-over points, (h) and wherein said connecting member is made of polyethylene.

2. The net for supporting upholstery in furniture as set forth in claim 1, wherein said longitudinal cords are made of polyethylene and said transverse cords are made of polyamide.

3. The net for supporting upholstery in furniture as set forth in claim 2, wherein said connecting member is bonded to said transverse and longitudinal cords in the region of said cross-over points.

* * * * *